US007272899B1

(12) United States Patent
Marak

(10) Patent No.: US 7,272,899 B1
(45) Date of Patent: Sep. 25, 2007

(54) EXCHANGEABLE STRAP SHOES

(76) Inventor: Karen Lee Marak, 1300 Old Pond La., Matthews, NC (US) 28105

( * ) Notice: Subject to any disclaimer, the term of this patent is extended or adjusted under 35 U.S.C. 154(b) by 170 days.

(21) Appl. No.: 10/777,594

(22) Filed: Feb. 13, 2004

(51) Int. Cl.
*A43B 3/24* (2006.01)
*A43B 3/12* (2006.01)

(52) U.S. Cl. ..... 36/101; 36/11.5

(58) Field of Classification Search ..... 36/101, 36/100, 15, 99, 71.5, 11.5
See application file for complete search history.

(56) References Cited

U.S. PATENT DOCUMENTS

| | | | | | |
|---|---|---|---|---|---|
| D94,640 | S * | 2/1935 | Stritter | 36/11.5 |
| 2,262,564 | A * | 11/1941 | Strother et al. | 36/2 R |
| 2,976,623 | A * | 3/1961 | Gallaway | 36/11.5 |
| 3,455,037 | A * | 7/1969 | Vlas Theodore et al. | 36/11.5 |
| 3,925,915 | A * | 12/1975 | Colli | 36/11.5 |
| 4,439,935 | A * | 4/1984 | Kelly | 36/101 |
| 4,461,102 | A * | 7/1984 | DeVincentis | 36/101 |
| 4,793,075 | A * | 12/1988 | Thatcher | 36/11.5 |
| 4,887,369 | A * | 12/1989 | Bailey et al. | 36/101 |
| 5,836,090 | A * | 11/1998 | Smith | 36/11.5 |
| 5,992,058 | A * | 11/1999 | Jneid | 36/100 |
| 6,442,870 | B1 * | 9/2002 | Tsai | 36/11.5 |
| 6,543,157 | B2 * | 4/2003 | Pan | 36/11.5 |
| 6,581,255 | B2 * | 6/2003 | Kay | 36/101 |
| 6,848,199 | B1 * | 2/2005 | Giannelli | 36/11.5 |
| 6,928,754 | B2 * | 8/2005 | Cambronero | 36/11.5 |
| 6,931,766 | B2 * | 8/2005 | Greene | 36/101 |
| 2002/0078600 | A1 * | 6/2002 | Berg et al. | 36/101 |
| 2002/0194750 | A1 * | 12/2002 | Feick | 36/101 |

FOREIGN PATENT DOCUMENTS

GB 2143420 A * 2/1985

OTHER PUBLICATIONS

Photograph of handbag strap (unknown whether prior art or not).
Photograph of duffel bag strap (prior art).
Photograph of strap (prior art).

* cited by examiner

*Primary Examiner*—Ted Kavanaugh
(74) *Attorney, Agent, or Firm*—Timothy R. Kroboth

(57) ABSTRACT

Shoes that are made to allow straps to be attached, removed, covered, or exchanged so that many different looks can be achieved. A properly equipped shoe base could be provided to which appropriate straps may be attached to the front or heel portion of the shoe base (or both). A variation is to provide a shoe base with an existing strap or straps. The strap or straps would be equipped with attachment points so that the existing straps can be covered, creating a different look for the shoe. Additionally, shoe bases could be purchased separately to allow for a more custom-fitting shoe for each foot than has been traditionally available.

16 Claims, 7 Drawing Sheets

EXCHANGEABLE STRAP SHOES

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF INVENTION

1. Field of Invention

This invention relates to an article of footwear, specifically to allow straps to be attached, removed, covered, or exchanged to a shoe base so that many different looks can be achieved.

2. Description of Prior Art

Each of the patents listed below relates to modifying a shoe in some manner, which none is as described in the current invention.

| U.S. Pat. No. | Title |
|---|---|
| 4,670,996 | Women's shoes with flexible spring steel shanks for use with replaceable heels of different heights |
| 4,967,492 | Adjustable girth shoes |
| 5,682,687 | Size-adjustable shoes |

U.S. Pat. No. 4,670,996 describes a method by which the heel of a shoe can be replaced with another of a different height. The shoes of this invention include straps that are transportable onto a shoe base of a different height, achieving the same affect.

U.S. Pat. No. 4,967,492 shows the girth of the shoe being adjusted. To a limited degree, the shoes of this invention result in a similar effect by varying the length of the strap in accordance with the width of an individual's foot. Because shoe bases could be purchased separately, acquiring a shoe of the appropriate length and width for each foot becomes economically feasible.

U.S. Pat. No. 5,682,687 shows the length of the shoe being adjusted. As aforementioned, shoe bases could be purchased separately so that acquiring a shoe of the appropriate length and width for each foot becomes economically feasible.

BACKGROUND OF THE INVENTION—OBJECTS AND ADVANTAGES

Conventional shoes are currently manufactured so that each shoe has a single appearance. I realized there were many similarities in the structure of shoes and wanted to find a way to alter a shoe so that it could have more than one appearance.

The current invention is a shoe that will provide to a person the ability to attach, remove, cover, replace, or exchange straps as desired. A shoe base would be provided and contain any number of attachment points whereupon straps could be affixed. The effects of changing the straps are:

a) straps could be arranged in a different pattern on a shoe base to give the shoe a different appearance;

b) straps could be removed from a shoe base and placed onto a different shoe base;

c) straps could be removed from a shoe base and replaced with different straps.

In summary, consumers would easily be given the ability to, in effect, design their own shoes.

The benefits of this superior product are numerous:

a) As styles and fashions change, new straps could be purchased resulting in a new look.

b) The consumer would not have to purchase as many shoes, but would enjoy the benefit of having various styles.

c) Less storage space would be required for both consumers and retailers.

d) The shoes would be a superior choice for travelers. Less baggage space would be required.

e) Children would require fewer pairs of shoes. This is an advantage as they quickly outgrow their shoes.

f) Shoe bases could be purchased separately. This would allow a consumer to have custom-fitted shoes in a cost-effective manner.

Possible Novel Features

The shoes of this invention:

a) could be the catalyst for a new style of wearing shoes; shoes that are coordinated but are not the same;

b) could have a customized tag with a 'designed by' individual's name (not shown), which could be attached to an appropriate attachment point on a shoe;

c) other ornamentation such as beads, charms, fringe, or any other decorative accessories (not shown) could be designed and contain an appropriate attachment piece; the attachment piece could be affixed to an attachment point to serve as a decorative item on a shoe.

DRAWINGS—FIGURES

The objects and advantages of the present invention will become more apparent when viewed in conjunction with the following drawings.

Figure 3:
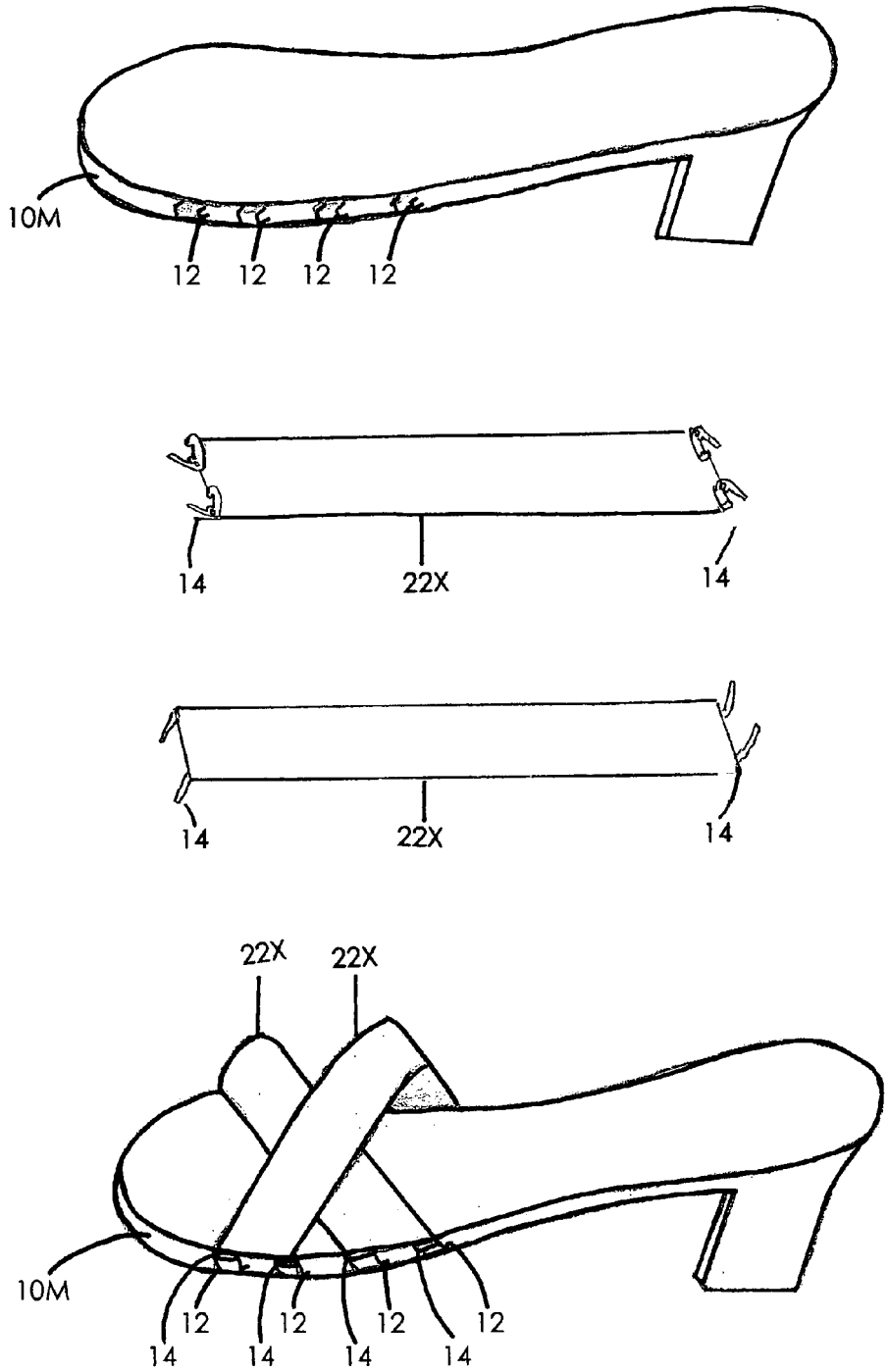
Figure 3A:
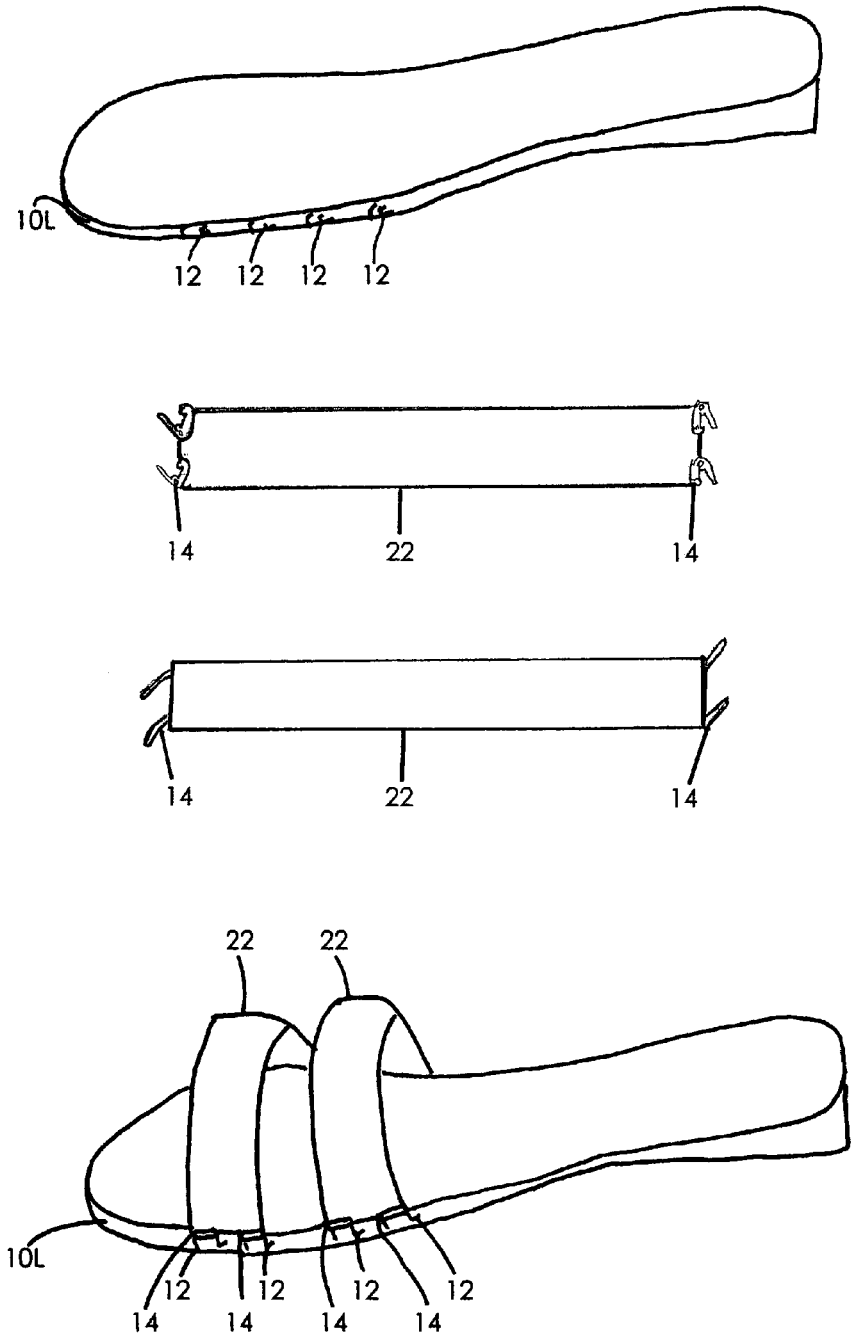
Figure 3B:
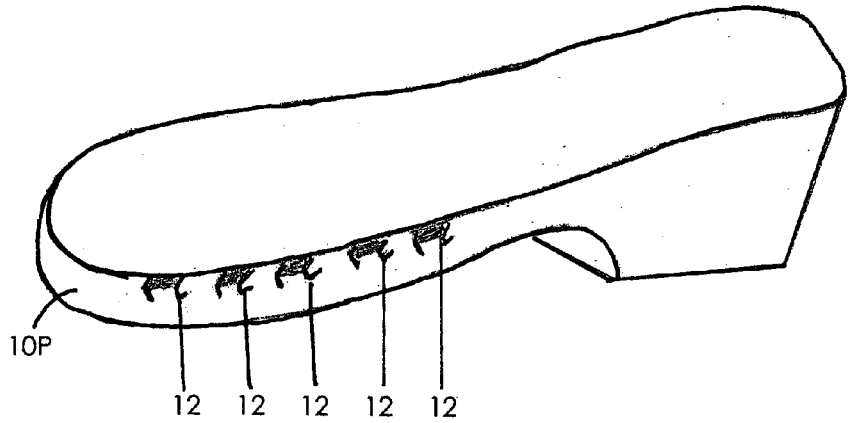
Figure 3B:
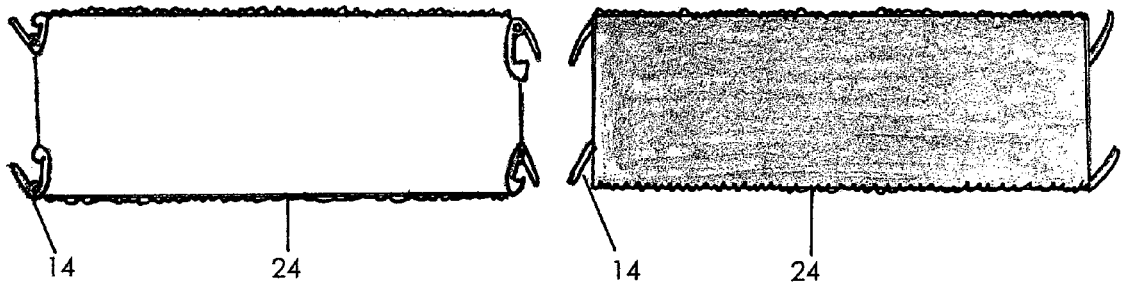
Figure 3B:
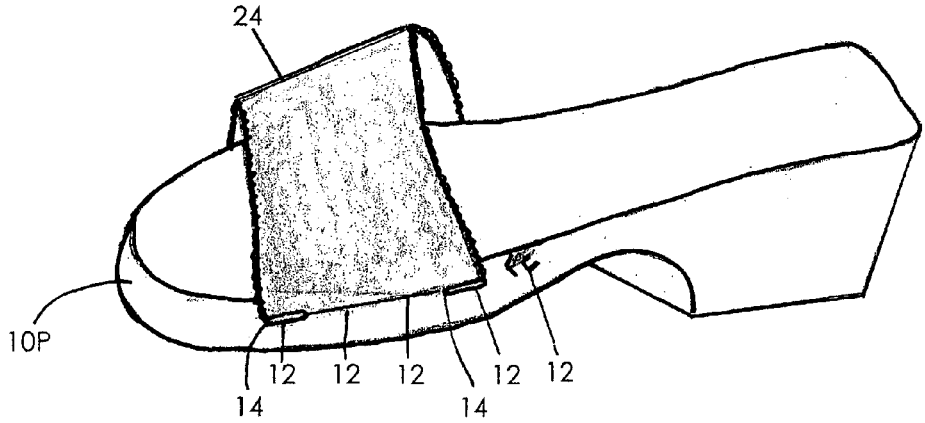

FIGS. 3, 3A, and 3B show variations of shoe bases and straps as well as assembled shoes.

Figure 4:
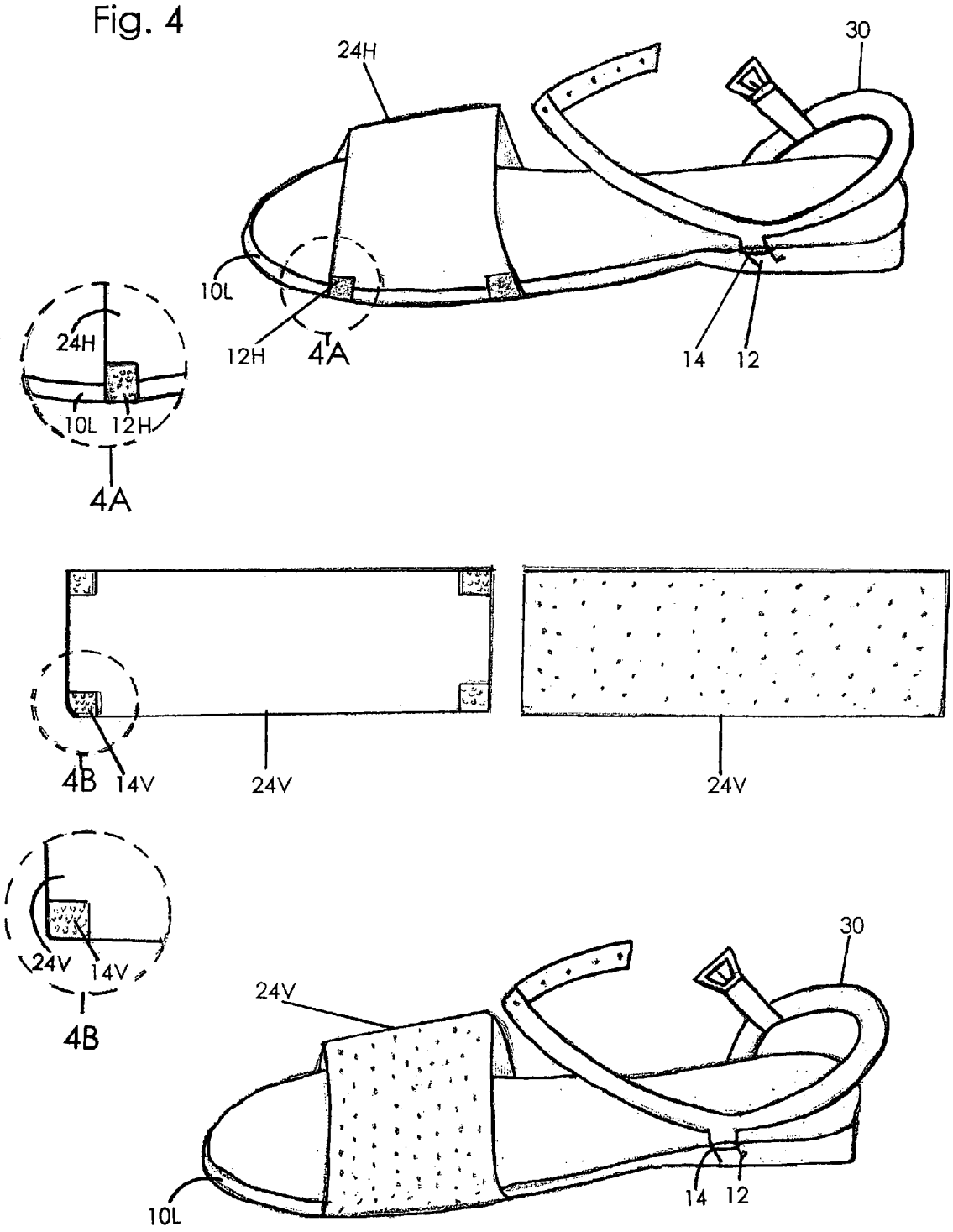

FIG. 4 shows a low heel shoe base, an existing plain strap with alternative attachment points, a patterned thick width strap with alternative attachment pieces, and an assembled shoe.

Figure 5:
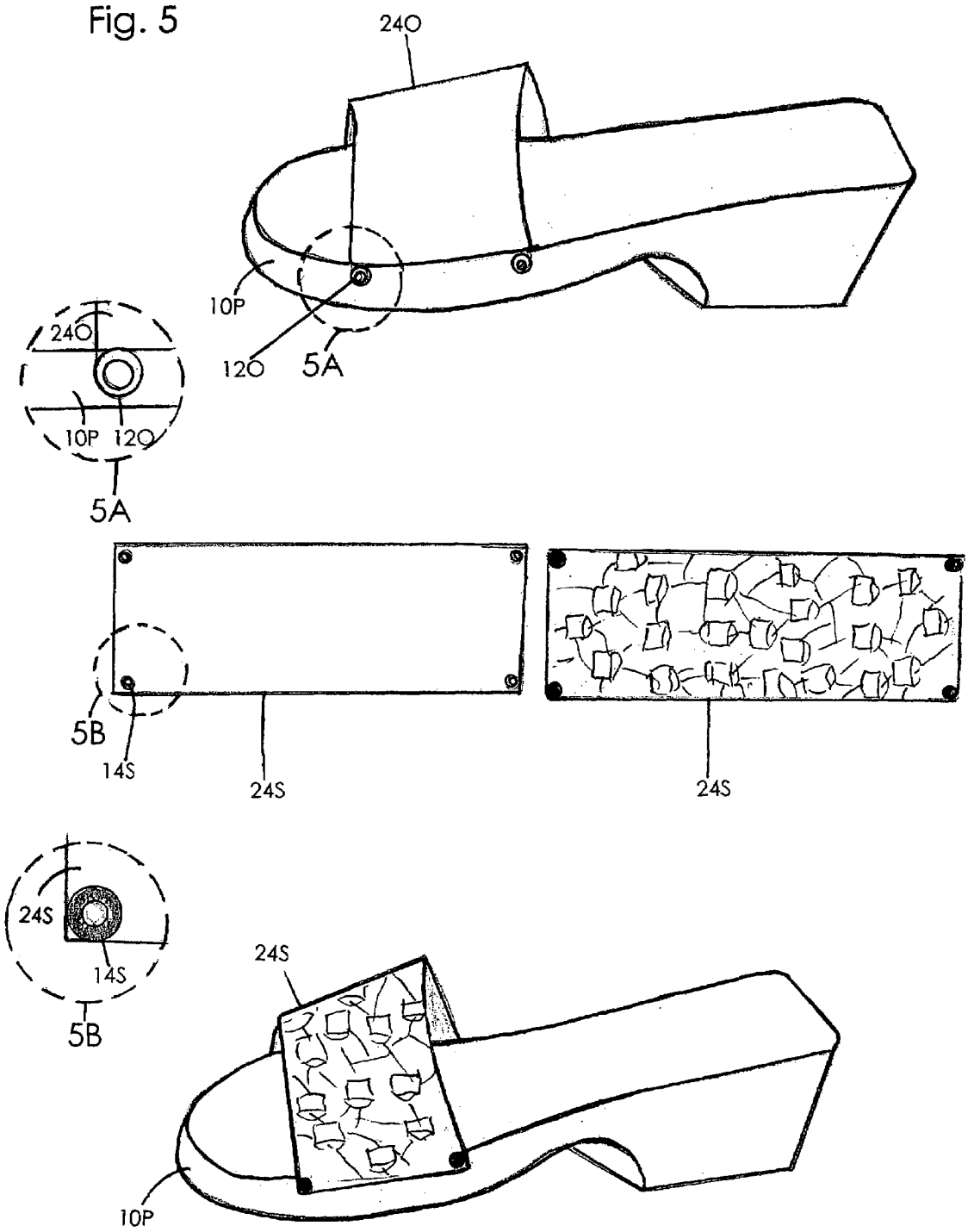

FIG. 5 shows a platform shoe base, an existing plain strap with alternative attachment points, a patterned thick width strap with alternative attachment pieces, and an assembled shoe.

DRAWINGS—REFERENCE NUMERALS—PREFERRED EMBODIMENTS—FIGS. 1, 2, 3, 3A, AND 3B

10H High Heel Shoe Base
10M Mid Heel Shoe Base
10P Platform Shoe Base
10L Low Heel Shoe Base
12 Guide Loop Attachment Point
14 Locking Pin Attachment Piece

20 Thin Width Strap
22 Medium Width Strap
22X Medium Width Angled Strap
24 Thick Width Strap DETAILED DESCRIPTION—PREFERRED EMBODIMENTS—FIGS. 1, 2, 3, 3A, AND 3B FIG. 1 shows a high heel shoe base 10H with strap attachment points 12, an example of a thin width strap 20 with attachment pieces 14, and an assembled shoe.

Figure 2:
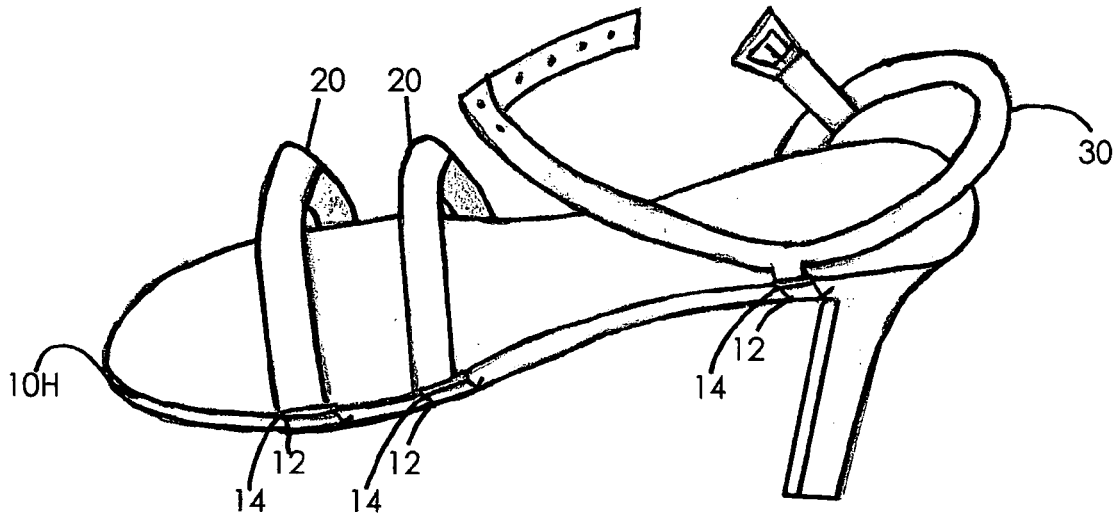
FIG. 2 shows high heel shoe bases with additional strap attachment points and assembled shoes.
Figure 2:
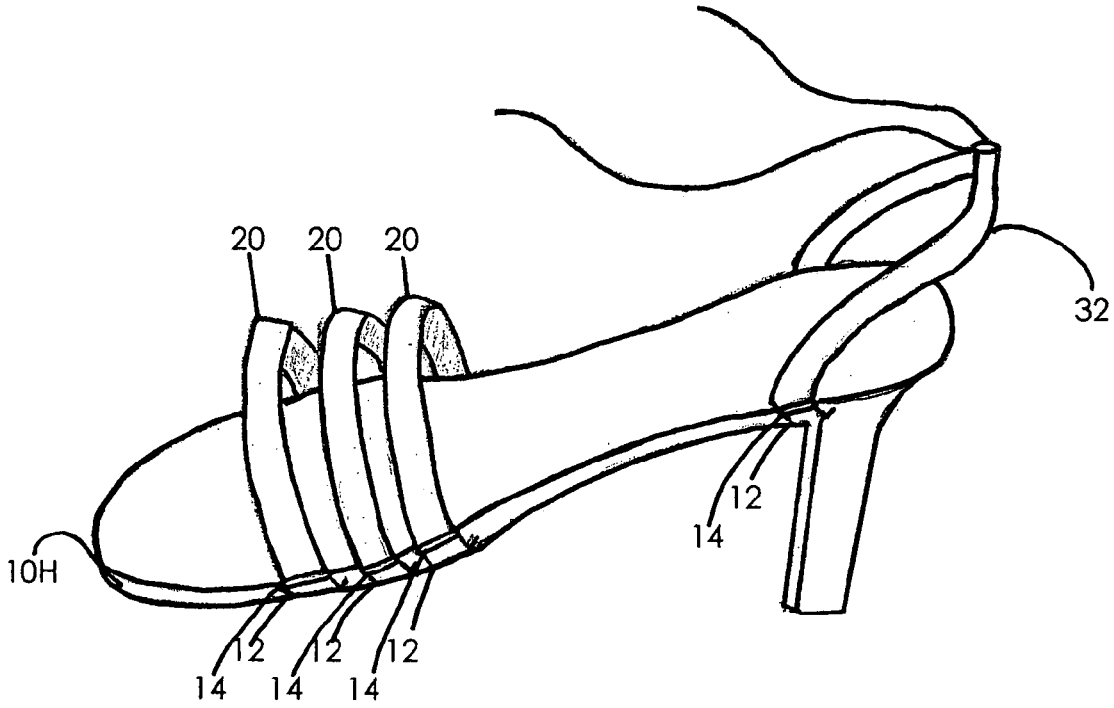

FIG. 2 shows a high heel shoe base 10H with additional strap attachment points 12 at the toe portion of the shoe base and by the heel portion of the shoe base. Also shown are straps appropriate for the heel portion of a shoe.

FIG. 3 shows a mid heel shoe base 10M with strap attachment points 12, an example of a plain medium width angled strap 22X with attachment pieces 14, and a shoe assembled using 2 medium width angled straps 22X attached in a crossed manner.

FIG. 3A shows a low heel shoe base 10L with strap attachment points 12, a medium width strap 22 with attachment pieces 14, and a shoe assembled using 2 medium width straps 22 attached in a parallel manner.

FIG. 3B shows a platform shoe base 10P with strap attachment points 12, a thick width strap 24 with attachment pieces 14, and an assembled shoe.

OPERATION—PREFERRED EMBODIMENTS—FIGS. 1, 2, 3, 3A, AND 3B

Figure 1:
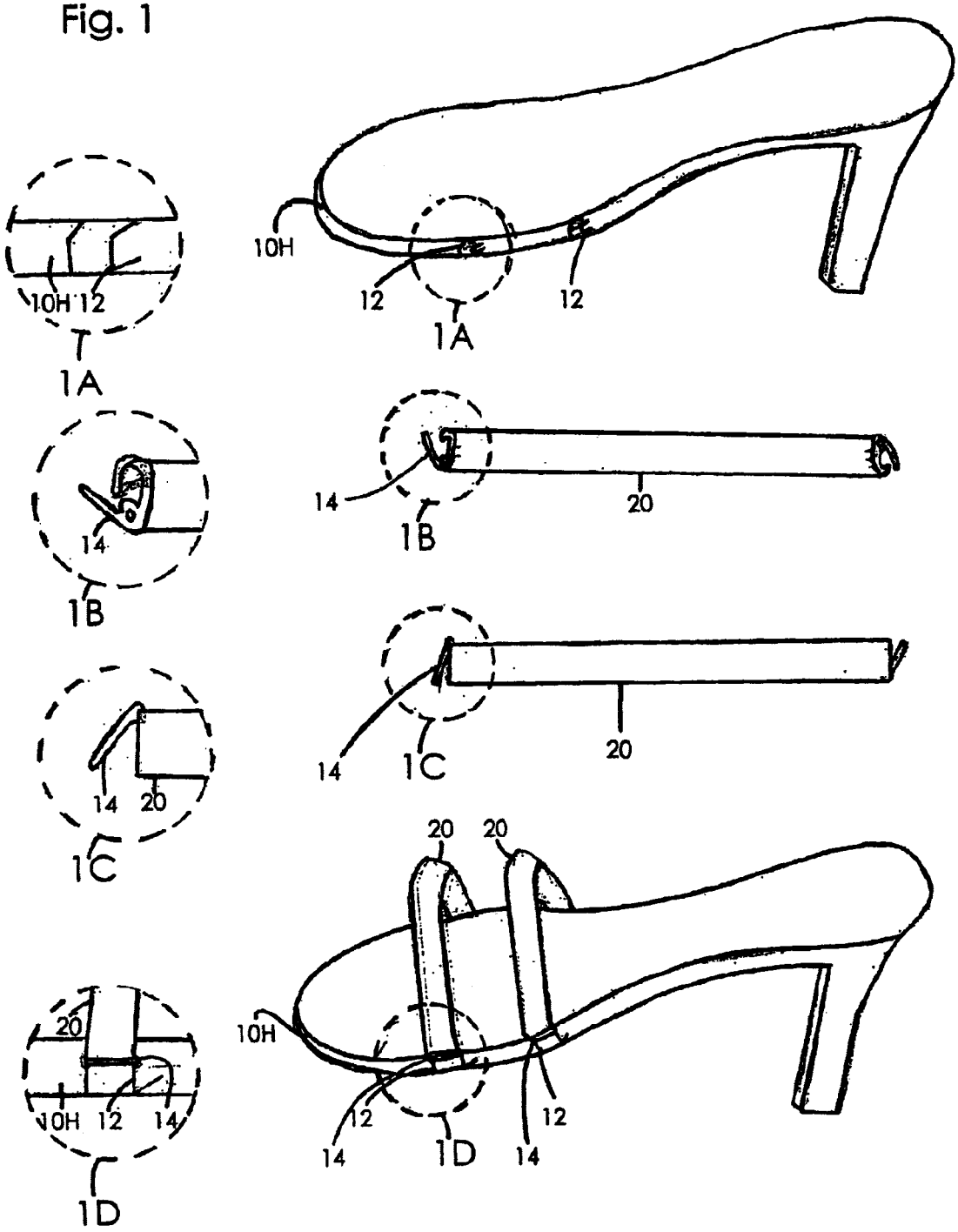
FIG. 1 shows a high heel shoe base with preferred strap attachment points, an example of a plain thin width strap with preferred attachment pieces, and an assembled shoe.

The first drawing in FIG. 1 shows a high heel shoe base 10H with strap attachment points 12. 1A is a close-up of the attachment point connected to the shoe base.

Show next in FIG. 1 is the back of a thin width strap 20 which contains locking pin attachment piece 14 on each side of the strap. 1B is a close-up of the back of the strap with the locking pin attachment piece in the open position.

The next drawing in FIG. 1 depicts the front of a thin width strap 20 when the locking pin attachment pieces are in the open position. 1C is a close-up of the front of the strap with the locking pin attachment piece 14 in the open position.

The last drawing in FIG. 1 is a shoe assembled using high heel shoe base 10H with 2 thin width straps 20 attached to the shoe base in a parallel manner. The pin of the locking pin attachment piece 14 is placed through guide loop attachment point 12 and placed in a locked position, securing the strap to the shoe base. 1D is a close-up of strap 20 attached to strap attachment point 12 with a locking pin attachment piece 14 in the closed position.

The first drawing in FIG. 2 shows a high heel shoe base 10H with additional strap attachment points 12 placed towards the heel of a shoe. Attached to these strap attachment points 12 is a typical buckle strap 30, which has locking pin attachment pieces 14 which are used to secure the strap to attachment points 12 of the shoe base in the manner described previously.

The next drawing in FIG. 2 shows other additional strap attachment points 12 placed toward the toe portion of a shoe. Attached to strap attachment points 12 at the toe portion of a shoe are 3 thin width straps 20 attached in a parallel manner. Attached to strap attachment points 12 toward the heel of the shoe is ankle tie strap 32, which has locking pin attachment pieces 14 which are used to secure the strap to attachment points 12 of the shoe base in the manner described previously.

The first drawing in FIG. 3 shows a mid heel shoe base 10M with strap attachment points 12.

The next drawing in FIG. 3 shows the back of a medium width angled strap 22X. Shown are locking pin attachment pieces 14 in the open position on each corner of the strap. Shown next is the front of medium width angled strap 22X with the locking pin attachment pieces 14 in the open position.

The last drawing in FIG. 3 is a shoe assembled using the mid heel shoe base 10M with 2 medium width angled straps 22X attached to the shoe base in a crossed manner. The locking pin attachment pieces 14 of the medium width angled straps 22X are used to secure the straps to attachment points 12 of the shoe base in the manner described previously.

The first drawing in FIG. 3A shows a low heel shoe base 10L with strap attachment points 12.

The next drawing FIG. 3A shows the back of a medium width strap 22. Shown are locking pin attachment pieces 14 in the open position on each corner of the strap. Shown next is the front of medium width strap 22 with the locking pin attachment pieces 14 in the open position.

The last drawing in FIG. 3A is a shoe assembled using low heel shoe base 10L with 2 medium width straps 22 attached to the shoe base in a parallel manner. The locking pin attachment pieces 14 of the medium width straps 22 are used to secure the straps to attachment points 12 of the shoe base in the manner described previously.

The first drawing in FIG. 3B shows a platform heel shoe base 10P with strap attachment points 12.

The next drawing in FIG. 3B shows the back of a thick width strap 24. Shown are locking pin attachment pieces 14 in the open position on each corner of the strap. Shown next is the front of thick width strap 24 with the locking pin attachment pieces 14 in the open position. Strap 24 is shown as a colored strap with a ruffled edge.

The last drawing in FIG. 3B is a shoe assembled using platform shoe base 10P with thick width strap 24 attached to the shoe base. The locking pin attachment pieces 14 of thick width strap 24 are used to secure the straps to attachment points 12 of the shoe base in the manner described previously.

DRAWINGS—ADDITIONAL REFERENCE NUMERALS—ALTERNATIVE EMBODIMENTS—FIGS. 4 AND 5

12H Hook and Loop Attachment Point
12O Snap Opening Attachment Point
14V Hook and Loop Attachment Piece
14S Snap Attachment Piece
24H Thick Width Strap with Hook and Loop Attachment Point
24O Thick Width Strap with Snap Opening Attachment Point
24V Thick Width Strap with Hook and Loop Attachment Piece
24S Thick Width Strap with Snap Attachment Piece

DETAILED DESCRIPTION—ALTERNATIVE EMBODIMENTS—FIGS. 4 AND 5

FIG. 4 shows a low heel shoe base 10L with thick width strap 24H affixed to it. Strap 24H is equipped with attachment points 12H at each corner of the strap. Thick width strap 24V with attachment pieces 14V is then shown, along with a shoe assembled using thick width strap 24V.

Shoe base 10L of FIG. 4 also has attachment points 12 towards the heel of the shoe. Ankle buckle strap 30 containing attachment point 14 is attached in the manner described previously.

FIG. 5 shows a platform shoe base 10P with thick width strap 24O affixed to it. Strap 24O is equipped with attachment points 12O. Thick width strap 24S with attachment pieces 14S is then shown, along with a shoe assembled using thick width strap 24S.

OPERATION—ALTERNATIVE EMBODIMENTS—FIGS. 4 AND 5

FIG. 4 shows a low heel shoe base 10L. The front portion of the shoe has a thick width strap 24H affixed to shoe base 10L. Strap 24H is equipped with hook and loop attachment points 12H at each corner of the strap. 4A is a close-up of attachment point 12H on strap 24H.

The next drawing in FIG. 4 is the back of a thick width strap 24V which contains the corresponding hook and loop attachment piece 14V on each corner of the strap. 4B is a close-up of the back of the strap with the corresponding hook and loop attachment piece 14V. The drawing next to it depicts the front of thick width strap 24V.

The last drawing in FIG. 4 is a shoe assembled using low heel shoe base 10L with thick width strap 24V attached so that it covers strap 24H.

FIG. 5 shows a platform shoe base 10P. The front portion of the shoe has a thick width strap 24O affixed to shoe base 10P. Strap 24O is equipped with snap opening attachment points 12O at each corner of the strap. 5A is a close-up of attachment point 12O on strap 24O.

The next drawing in FIG. 5 is the back of a thick width strap 24S which contains snap attachment piece 14S on each corner of the strap. 5B is a close-up of the back of the strap with snap attachment piece 14S. The drawing next to it depicts the front of thick width strap 24S. The last drawing in FIG. 5 is a shoe assembled using platform 10P with thick width strap 24S attached so that it covers strap 24O.

CONCLUSIONS, RAMIFICATIONS, AND SCOPE

Accordingly, the reader will see that the shoes of this invention provide a consumer the ability to easily and cost effectively own shoes with many different fabrics, colors, and styles of strap configurations.

The transportability of straps from one shoe base to another is one of the most desirable advantages of the aforementioned shoe. Another highly desirable feature is the ability to rearrange the straps in different methods on the toe portion of the shoe. Different colors, fabrics, and patterns can be used as the consumer wishes. Yet another advantage of the shoe is the ability to change or remove straps that support the ankle at the heel portion of the shoe. As with the straps at the top portion of the shoe, different colors, fabrics, and patterns can be used as the consumer wishes.

Although not shown in the drawings, there are features mentioned in the "possible novel features" paragraph that are worth consideration. First mentioned is the idea for wearing shoes that are coordinated, but are not the same. In a world where fashion styles come and go, and then resurface again, this is something that hasn't been done before! Also mentioned are decorative pieces or design tags that could be equipped with an appropriate attachment piece and secured to the attachment points on a shoe base, providing the opportunity to create a truly unique shoe.

In summary, consumers would easily be given the ability to, in effect, design their own shoes.

In order to convey an understanding of the present invention, it has been described above in terms of presently preferred embodiments as well as additional alternative embodiments. However, there are many configurations for shoes with exchangeable straps that are not specifically described herein but with which the present invention is applicable. Therefore, the present invention should not be seen as limited to the particular embodiments described herein because it has applicability to a wide variety of shoe designs. All modifications, variations, or equivalent arrangements that are within the scope of the attached claims should be considered within the scope of this invention.

Thus, the scope of this invention should be determined by the appended claims and their legal equivalents, rather than by the examples given.

The invention claimed is:

1. Shoes having exchangeable straps, said shoes comprising shoe bases and a plurality of strap attachment loops on the sides of said shoe bases through which exchangeable shoe straps terminating in attachment structures comprising pivotable locking pins are detachably secured, wherein said pivotable locking pins have an open position, and in a closed strap-securing position, each form a closed loop.

2. The shoes of claim 1, wherein said shoes are fashion style coordinated, yet different, in appearance, and constitute a pair of shoes to be worn together.

3. The shoes of claim 1, further comprising strap attachment loops on the sides of said shoe bases in addition to said plurality of strap attachment loops through which said shoe straps are detachably secured.

4. The shoes of claim 1, wherein said pivotable locking pins extend through said strap attachment loops.

5. A footwear system comprising (a) shoe bases, and (b) exchangeable shoe straps detachably securable to said shoe bases through shoe strap attachment loops, by attachment structures comprising pivotable locking pins that have an open position, and that in a closed strap-securing position each form a closed loop.

6. The footwear system of claim 5, wherein said shoe bases are of different styles or fit, and said shoe bases are selected from high heel shoe bases, mid heel shoe bases, low heel shoe bases and platform shoe bases.

7. The footwear system of claim 5, from which a user assembles a pair of shoes that is fashion style coordinated, yet different in appearance, further comprising the user wearing said pair of shoes together.

8. The footwear system of claim 5, wherein said exchangeable shoe straps differ in strap color.

9. The footwear system of claim 5, wherein said exchangeable shoe straps are made of different fabrics.

10. The footwear system of claim 5, wherein said exchangeable shoe straps differ in strap patterns.

11. The footwear system of claim 5, wherein said exchangeable shoe straps differ in strap width.

12. The footwear system of claim 5, wherein said strap attachment loops are on the sides of said shoe bases.

13. The footwear system of claim 5, wherein said pivotable locking pins extend through said strap attachment loops.

14. Shoes having exchangeable straps, said shoes comprising shoe bases and a plurality of strap attachment loops to which exchangeable shoe straps are detachably secured by attachment structures comprising pivotable locking pins that have an open position, and that in a closed strap-securing position each form a closed loop, wherein said pivotable locking pins extend through said strap attachment loops.

15. The shoes of claim 14, wherein said plurality of strap attachment loops is on the sides of said shoe bases.

16. The shoes of claim 14, further comprising strap attachment loops on the sides of said shoe bases in addition to said plurality of strap attachment loops to which said shoe straps are detachably secured.

* * * * *